United States Patent [19]

Yasuga

[11] 4,026,262

[45] May 31, 1977

[54] TILE CUTTER

[76] Inventor: Masaki Yasuga, 21-Go, 15-Ban, Minami 3-chome, Oimazato, Higashinari, Osaka, Japan

[22] Filed: Aug. 22, 1975

[21] Appl. No.: 606,949

[30] Foreign Application Priority Data

Oct. 2, 1974 Japan ..... 49-114171

[52] U.S. Cl. ..... 125/23 T; 225/96.5

[51] Int. Cl.[2] ..... B28D 1/32

[58] Field of Search ..... 125/23; 225/96.5

[56] References Cited

UNITED STATES PATENTS

| | | | |
|---|---|---|---|
| 1,828,796 | 10/1931 | Aitchison | 125/23 R |
| 1,873,721 | 8/1934 | Postley | 125/23 R |
| 1,995,741 | 3/1935 | Granite | 125/23 T |
| 2,289,985 | 7/1942 | Nastri | 125/23 R |
| 2,585,966 | 2/1952 | Sanders | 51/231 |

FOREIGN PATENTS OR APPLICATIONS

| | | | |
|---|---|---|---|
| 781,433 | 5/1935 | France | 125/23 T |

*Primary Examiner*—Harold D. Whitehead
*Attorney, Agent, or Firm*—Wenderoth, Lind & Ponack

[57] ABSTRACT

A tile cutter which comprises mainly a guide rod provided above and in parallel with a base of the tile cutter and a handle having fins with attachments, a movable cutter, a link, sliding plates and a cam. The handle is movably and slidably fitted in the guide rod and tile cutting can be effected only by sliding the handle along the guide rod to mark a cut line and then by grasping lightly the handle and the guide rod by one hand.

4 Claims, 7 Drawing Figures

TILE CUTTER

This invention relates to a tile cutter which affords easy and accurate cutting of tiles, with less labour and irrespective of thickness of the tile.

In the conventional tile cutter, a handle for cutting is slidably fitted in a guide rod and a cut line is marked preliminarily on the surface of a tile by sliding the handle along the guide rod, and the tile is cut by pressing down the handle. This method, however, has such disadvantage that with repeated tile cutting, an opening of the handle by which the handle slides along the guide rod becomes larger due to wear, with the result that the handle becomes loose in relation to the longitudinal direction of the guide rod. Accordingly it becomes difficult to mark an accurate cut line on the surface of a tile to be cut. Also, if such looseness of the handle is adjusted, the handle becomes stiff and will not slide smoothly. Moreover, when cutting a tile the handle must be manipulated in such a fashion that a cutter rests his weight upon the handle, which requires more labour.

The present invention has for an object to eliminate the above disadvantage. The nature and advantage of the present invention will be understood more clearly from the following description made with reference to the accompanying drawings, in which.

Figure 6B:
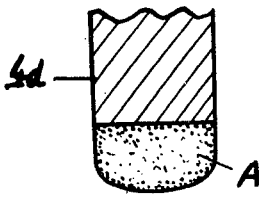
FIG. 6A is a cross section, on an enlarged scale, of the lower end portion of a fin.

FIG. 6B in cross section, on an enlarged scale, of a modified form of the lower end portion of a fin.

In the drawings, numeral 1 denotes a base of a tile cutter. This base is made by aluminium die casting, forging, etc. or is made of synthetic resin, wood, etc. Provided oppositely at both ends of the base are props 2, 2, which are made integrally with the base or may be made separately from the base 1 and then bolted in the base. Provided between upper end portions of these opposite props 2, 2 and in parallel with the base is a guide rod 3 of flat board shape. Both ends of this guide rod 3 and upper end portions of props 2, 2 are fastened together by bolts. A handle 4 for tile cutting is fitted slidably around the guide rod 3. Provided just below the guide rod 3 and on the base 1 is a straight-line protuberance 1*b*, on both sides of which are laid mats G, G made of sponge, rubber or the like.

Figure 3:
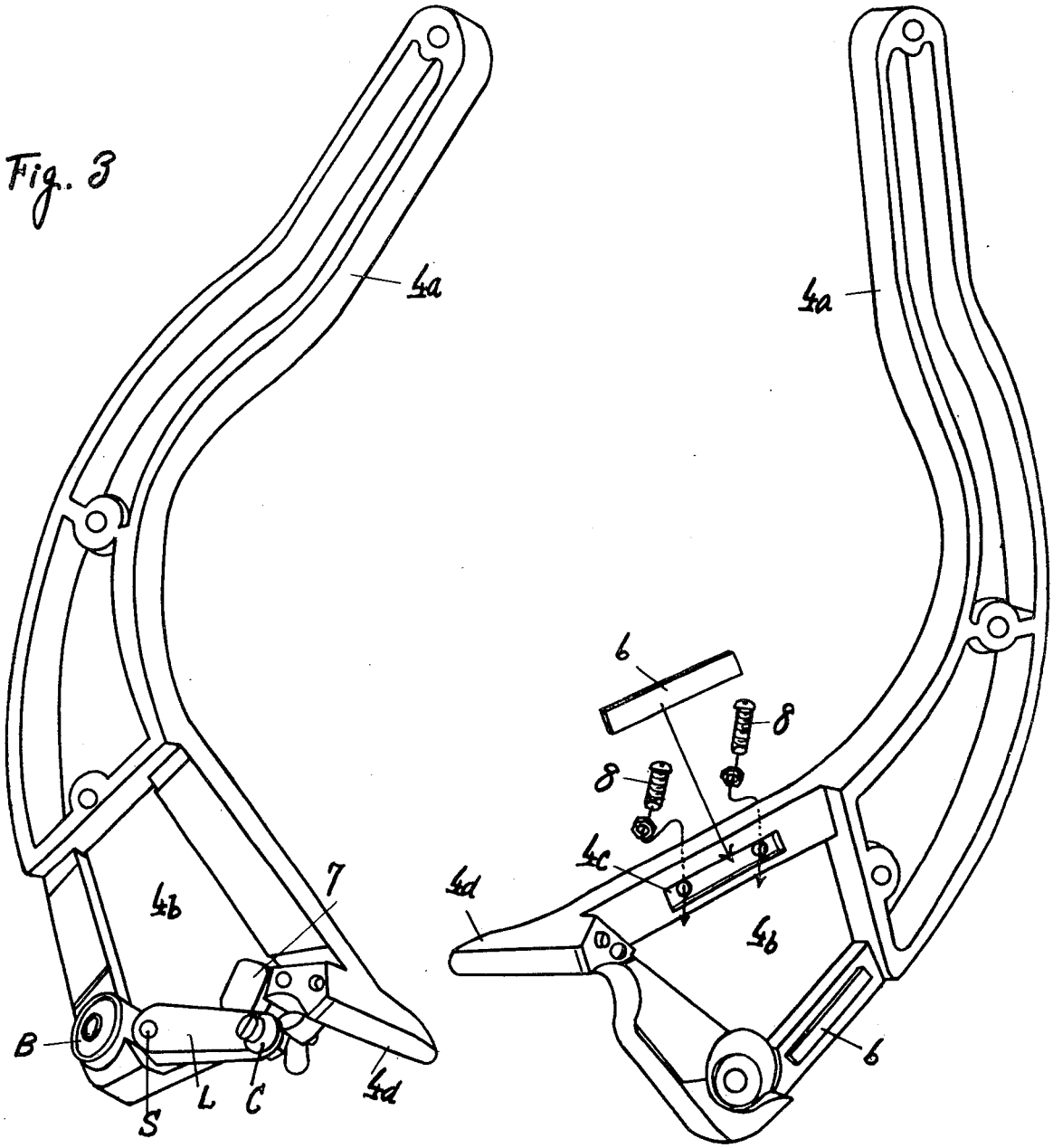
FIG. 3 is a perspective view of a handle as it is broken down.

Made integrally with the base 1 and at the inside of the opposite props 2, 2 are scales S2, S3. These scales are a little above the level of the surface of the base 1 and are graduated in m.m., c.m., inch, or the like. Provided along these scales S2 and S3 are dovetail grooves or the like 1*a*, 1*a*, 1*a*. A movable scale S1 is mounted between scales S2 and S3 in such a fashion that it can slide along the grooves 1*a* 1*a* and can be be fixed at the desired position by thumscrews. An edge of a tile to be cut is held to one side of the movable scale S1 to determinea cut line. As illustrated in the drawings, the handle 4 is bow-shaped to facilitate tile cutting and comprises two substantially symmetrical handle pieces 4*a*, 4*a* so as to facilitate forging or casting of the handle. These handle pieces have at their inner side opposite concavities 4*b*, 4*b*. When these handle pieces 4*a*, 4*a* are connected integrally, an opening by which the handle 4 slides along the guide rod 3 is formed by these concavities 4*b*, 4*b*. As shown in FIG. 3, one of the handle pieces has grooves 4*c*, 4*c* on both sides of the concavity 4b. In each of these grooves 4*c*, 4*c*, a sliding plate 6 made of synthetic resin, bakelite or the like is fitted. This sliding plate 6 enables the handle to slide along the guide rod smoothly while it keeps contact with the side of the guide rod 3. The other handle piece 4*a* having no sliding plate has a cutter C of disc type rotatably provided at the lower end of a link L which is arranged slidably at the lower end of the handle piece through the medium of an axis S. Held to one side of said link L is a peripheral surface of a cam 7 rotatably provided at said handle piece. Said cam 7 is turned by the operation from the outside, whereby the link L is moved upwardly or downwardly to adjust the protruding of the cutter C according to the tile to be cut and thus cutting of tiles, whether they are mosaic or not and irrespective of their thickness, can be effected easily and accurately without damaging the cutter.

Figure 4:
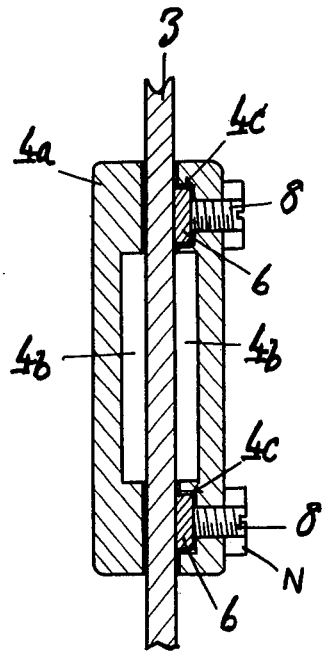
FIG. 4 is a cross section showing the relation between a guide rod passing through the handle and sliding plates.
Figure 5:
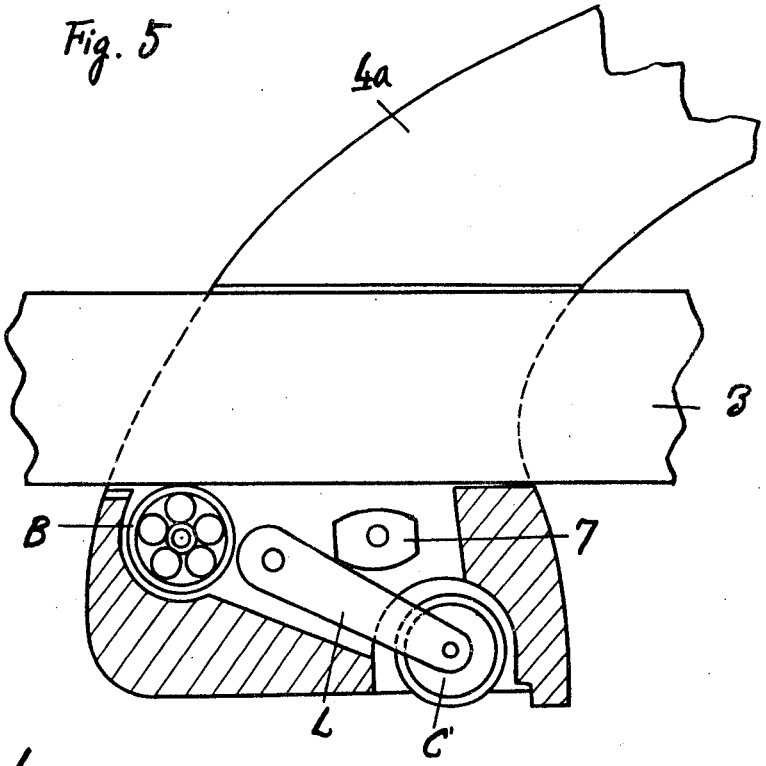
FIG. 5 is a diagram showing a device to adjust protruding of a cutter at the lower end of a link.
Figure 6A:
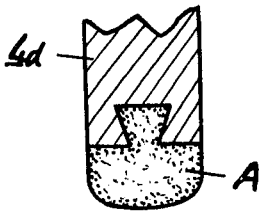

The aforementioned sliding plate 6 is made of synthetic resin, ebonite, or the like of small frictional resistance and is so shaped as to fit in the groove 4*c* at the bottom of the concavity 4*b*. As shown in FIG. 4, an adjusting bolt 8 is provided at the back of the sliding plate 6 or at the bottom part of the groove 4*c* in such a fashion that it pierces the handle piece 4*a* and its tip is held to the back of the sliding plate 6. By the tightening force of this adjusting bolt 8, the sliding plate 6 is pressed toward the side of the guide rod 3 at all times. In this case, however, the sliding plate 6 and the side of the guide rod 3 do not make direct contact with each other but it is so adjusted by means of a nut N that there is left at all times a minute gap between them to enable the handle to slide smoothly along the guide rod 3, free from "play". Two or more sliding plates may be fitted in each groove 4*c* if necessary. It is also possible to provide sliding plates in both handle pieces. In order to make the handle slide smoothly along the guide rod in concert with the sliding plate 6, bearing B is built in the handle 4 in such a fashion that it keeps contact with the under surface of the guide rod 3. This bearing B serves as a fulcrum of the handle pushing down in cutting a tile. Fins 4*d*, 4*d* are provided integrally with the handle pieces 4*a*, 4*a* for pressing the surface of a tile to be cut. Fixed to the underside of the fin 4*d* is an attachment A comprising natural rubber, artificial rubber, synthetic resin or the like. In cutting a tile, this attachment A makes direct contact with the surface of the tile so as to prevent the surface of the tile from being stained or scratched. This attachment may be bonded to the underside of the fin or, as shown by FIG. 6A, may be fitted in a groove made at the underside of the fin and fixed with an adhesive.

Figure 1:
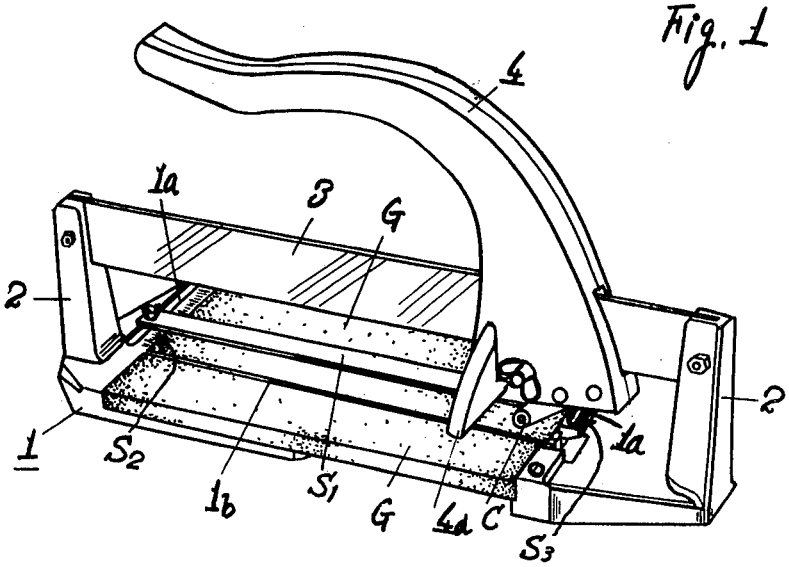
FIG. 1 is a perspective view of the whole shape of a tile cutter according to the present invention.
Figure 2:
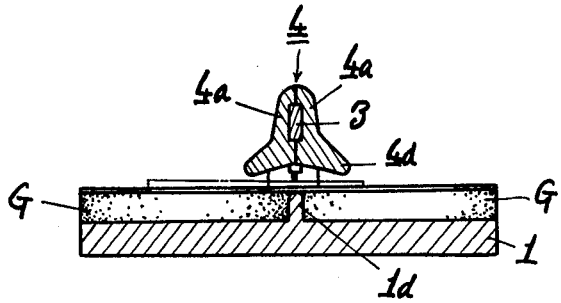
FIG. 2 is a cross sectional view of the tile cutter as it is cutting a tile.

When cutting a tile by a tile cutter of the construction as mentioned above, the handle in such a position as shown in FIG. 1 is pulled toward a cutter (an operative); a tile to be cut is placed on the mat G on the base 1; the tile cutting position is set by scales; the height or the protruding of the cutter C is adjusted according to the kind and thickness of the tile to be cut; the handle is pushed forward as it is lightly pressed against the surface of the tile, whereby the tile is given a cut line as in the case of glass cutting; both the grip part of the handle and the guide rod are lightly grasped by one hand, whereby the handle is pushed down and the tile is cut along the cut line accurately. In this case, the pressing down force of the handle should vary with the thickness and the kind of a tile to be cut, but small pressing down force is enough for cutting a tile because the principles of the lever and fulcrum are utilized with the bearing B in the handle as a fulcrum. Since there is provided a minute gap between the sliding plate built in the handle and the guide rod, within the limit that the handle does not play, the handle is enabled to slide accurately and lightly. Even if the sliding plate is worn due to repeated tile cutting and the gap between itself and the guide rod has become large enough to cause play of the handle, such trouble can be eliminated by readjusting the gap by means of the adjusting bolt.

According to the present invention, when the handle is slid along the guide rod in tile cutting, it slides smoothly and without play in longitudinal direction of the guide rod because there exists a minute gap between the side of the guide rod and the sliding plate. Moreover, since the bearing is provided in the handle and cutting is effected by utilizing the principles of the lever and fulcrum, with this bearing as a fulcrum of the handle, and by grasping lightly the handle and the guide rod by one hand, tile cutting by the tile cutter according to the present invention can be effected with less labour. The tile cutter according to the present invention is further provided with a cam 7, by the operation of which the cutter C is adjusted in its extent of protruding. Thus, the tile cutter according to the present invention can select the optimum protruding of the cutter C according to thickness of tiles, kind of tiles (for example, mosaic tile or not), etc. Furthermore, since the tile cutter according to the present invention has attachments of hard rubber or synthetic resin at the underside of the fins of the handle, it does not stain nor scratch the surface of tiles in tile cutting.

What is claimed is:

1. A tile cutter for cutting tile placed thereon, comprising:

a base;

a guide rod above and parallel to said base;

prop means extending upward from said base for supporting said guide rod above said base, cushion means supported on said base beneath said guide rod for supporting thereon and cushioning said tile to be cut on both sides of the cut; and cutter means slidably mounted on said guide rod for marking and cutting tile supported on said cushion means, said cutter means comprised of:

a bow shaped handle means having an opening therethrough slidably and pivotally fitted to said guide rod through said opening for sliding back and forth along said guide rod and pivoting downward against a tile on said cushion means to break said tile, said handle means further having outward and downward sloping fins on both sides thereof on either side of said guide rod which press against said tile when said handle means is forced downward, adjustable sliding plate means mounted in said opening in said handle means and biased slightly toward said guide rod for enabling said handle means to slide freely along said guide rod, a disc-type cutter having pivotably mounted support means within said opening and rotatable downward from said opening against said tile on said cushion means for cutting said tile when said handle means is moved back and forth along said guide rod, cam means rotatably mounted to said handle means within said opening and abutting said support means for rotating against said support means and adjusting the downward projection of said cutter beneath said handle means, and bearing means mounted to said handle means within said opening beneath said guide rod for easing the sliding motion of said handle means along said guide means and for providing a fulcrum when said handle means is forced downward to break said tile.

2. A tile cutter as claimed in claim 1, further comprising:

movable graduated scale means on said base and extending thereacross for measuring and adjusting the size of said tile being cut.

3. A tile cutter as claimed in claim 1 wherein:

said sloping fins have dovetailed grooves in the ends thereof; and pad means are fitted into said dovetailed grooves for protecting the surface of said tile from being injured by the contact of said fins thereagainst.

4. A tile cutter as claimed in claim 1, wherein said cushion means is a rubber mat.

* * * * *